US007625296B2

(12) United States Patent
Wu et al.

(10) Patent No.: US 7,625,296 B2
(45) Date of Patent: Dec. 1, 2009

(54) DIRECTIONAL PRACTICE DEVICE

(76) Inventors: Victor Wu, 6F., No. 73, Sec. 1, Huanhe N. Rd., Datong District, Taipei City 103 (TW); Leo Wu, 6F., No. 73, Sec. 1, Huanhe N. Rd., Datong District, Taipei City 103 (TW); Authar Wu, 6F., No. 73, Sec. 1, Huanhe N. Rd., Datong District, Taipei City 103 (TW)

( * ) Notice: Subject to any disclaimer, the term of this patent is extended or adjusted under 35 U.S.C. 154(b) by 0 days.

(21) Appl. No.: 12/107,709

(22) Filed: Apr. 22, 2008

(65) Prior Publication Data

US 2009/0062028 A1 Mar. 5, 2009

(30) Foreign Application Priority Data

Sep. 5, 2007 (TW) ..... 96133160 A

(51) Int. Cl.
*A63B 69/36* (2006.01)
*A63B 53/06* (2006.01)
*A63B 57/00* (2006.01)

(52) U.S. Cl. ..... 473/265; 473/137; 473/261

(58) Field of Classification Search ..... 473/132, 473/134, 136, 137, 190, 195, 219, 257, 258, 473/260, 261, 262, 264, 265, 278
See application file for complete search history.

(56) References Cited

U.S. PATENT DOCUMENTS 1,745,201 A * 1/1930 Alston ..... 473/166
2,043,273 A * 6/1936 Watson ..... 473/190
2,110,925 A 3/1938 Trangmar
5,018,739 A 5/1991 Hale
5,582,325 A * 12/1996 Janier ..... 473/137
5,704,844 A * 1/1998 Luther ..... 473/137
6,315,676 B1 * 11/2001 Sandlin ..... 473/137
6,328,659 B1 * 12/2001 Peterson ..... 473/137
6,419,589 B1 * 7/2002 Carter ..... 473/134
6,716,113 B1 4/2004 Manning (Continued)

FOREIGN PATENT DOCUMENTS

GB 2350569 5/2003

OTHER PUBLICATIONS

GB0808415.4 Corrected Search Report under Section 17, Aug. 28, 2008.

*Primary Examiner*—Nini Legesse
(74) *Attorney, Agent, or Firm*—DLA Piper LLP (US)

(57) ABSTRACT

A directional practice device includes an elongated ball-receiving member disposed on a flat surface and having a slot adapted for receiving a plurality of golf balls, and an upright heel-engaging surface disposed at a side of the ball-receiving member and perpendicular to the flat surface. The heel-engaging surface has a lower end defining a side of a head-traveling path extending along a longitudinal direction. The golf balls can be pushed by a putter head to drop from the slot onto the head-traveling path one at a time. After one of the golf balls drops onto the head-traveling path, the putter head can be moved along the head-traveling path to strike the one of the golf balls in the longitudinal direction in such a manner that the heel of the putter head moves on the heel-engaging surface.

9 Claims, 8 Drawing Sheets

U.S. PATENT DOCUMENTS

| | | | | |
|---|---|---|---|---|
| 6,929,556 | B1 * | 8/2005 | Wolbert | 473/137 |
| 7,255,648 | B1 | 8/2007 | Romeo | |
| 2002/0091008 | A1 | 7/2002 | Lee | |
| 2005/0130756 | A1 | 6/2005 | Chang | |
| 2005/0159233 | A1 | 7/2005 | Piche | |
| 2008/0234061 | A1 * | 9/2008 | Luna | 473/137 |

* cited by examiner

DIRECTIONAL PRACTICE DEVICE

CROSS-REFERENCE TO RELATED APPLICATION

This application claims priority of Taiwanese Application No. 096133160, filed on Sep. 5, 2007.

BACKGROUND OF THE INVENTION

1. Field of the Invention

This invention relates to a directional practice device, and more particularly to a directional practice device for golf putting training.

2. Description of the Related Art

Referring to FIG. 1, a conventional directional practice device 1 disclosed in U.S. Pat. No. 7,172,516 includes two parallel rails 11 and a directional frame 12. Each of the rails 11 is formed with a groove 111. The directional frame 12 is formed with an opening 121 for receiving a golf ball (not shown). Two rollers 13 are disposed respectively on two opposite sides of the directional frame 12, and are mounted respectively and movably within the grooves 111.

During practice, a putter head is locked on the directional frame 12, and is co-movable with the directional frame 12 along the grooves 111 for training steadiness of rectilinear movement of the putter head.

However, it is necessary for the conventional directional practice device 1 to lock the putter head on the directional frame 12 prior to practice and to remove the putter head from the directional frame after practice, thereby resulting in inconvenience during use.

Furthermore, the golfer must bend down to put one golf ball into the opening 121 between any two consecutive putting strokes to thereby interrupt muscle memory. Such muscle memory interruption affects adversely the putting training effect. Further, during practice, repeated bending-down causes golfer discomfort, such as sore waist and aching back.

SUMMARY OF THE INVENTION

The object of this invention is to provide a directional practice device that is convenient during use and that allows a golfer to put a golf ball onto a head-traveling path without bending-down.

According to this invention, there is provided a directional practice device adapted to be disposed on a flat surface and adapted for use with a plurality of golf balls and a putter head, the putter head having a heel, the directional practice device comprising an elongated ball-receiving member adapted to be disposed on the flat surface and having a slot adapted for receiving the golf balls, and an upright heel-engaging surface disposed at a side of the ball-receiving member % and adapted to be perpendicular to the flat surface, the heel-engaging surface having a lower end defining a side of a head-traveling path extending along a longitudinal direction, the slot being positioned such that the golf balls can be pushed by the putter head to drop from the slot onto the head-traveling path one at a time, wherein, after one of the golf balls drops onto the head-traveling path, the putter head can be moved along the head-traveling path to strike the one of the golf balls in the longitudinal direction in such a manner that the heel moves on the heel-engaging surface.

Since it is not necessary to lock the putter head on any portion of the directional practice device, the directional practice device is convenient during use.

Furthermore, the golfer can move the one of golf balls from the slot onto the head-traveling path by use of the putter head without bending-down, interruption of muscle memory and golfer discomfort resulting from the bending-down can be prevented.

BRIEF DESCRIPTION OF THE DRAWINGS

These and other features and advantages of this invention will become apparent in the following detailed description of the preferred embodiments of this invention, with reference to the accompanying drawings, in which.

DETAILED DESCRIPTION OF THE PREFERRED EMBODIMENTS

Figure 1:
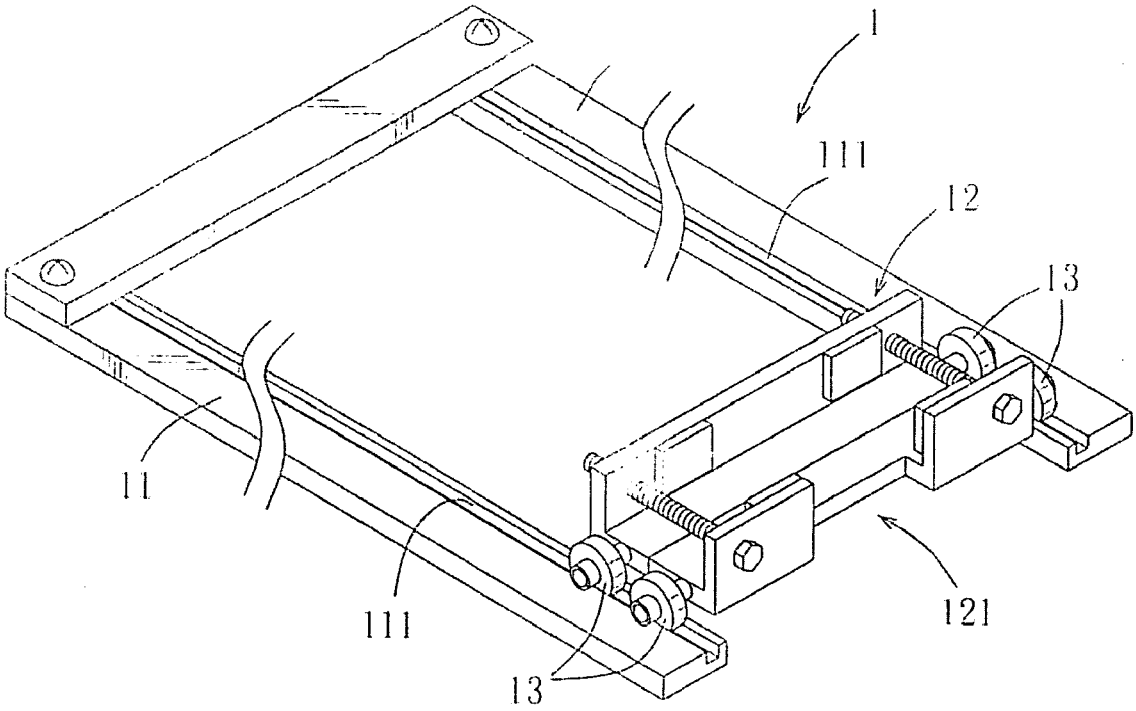
FIG. 1 PRIOR ART
FIG. 1 is a perspective view of a conventional directional practice device disclosed in U.S. Pat. No. 7,172,516.

Before the present invention is described in greater detail in connection with the preferred embodiments, it should be noted that similar elements and structures are designated by like reference numerals throughout the entire disclosure.

Figure 2:
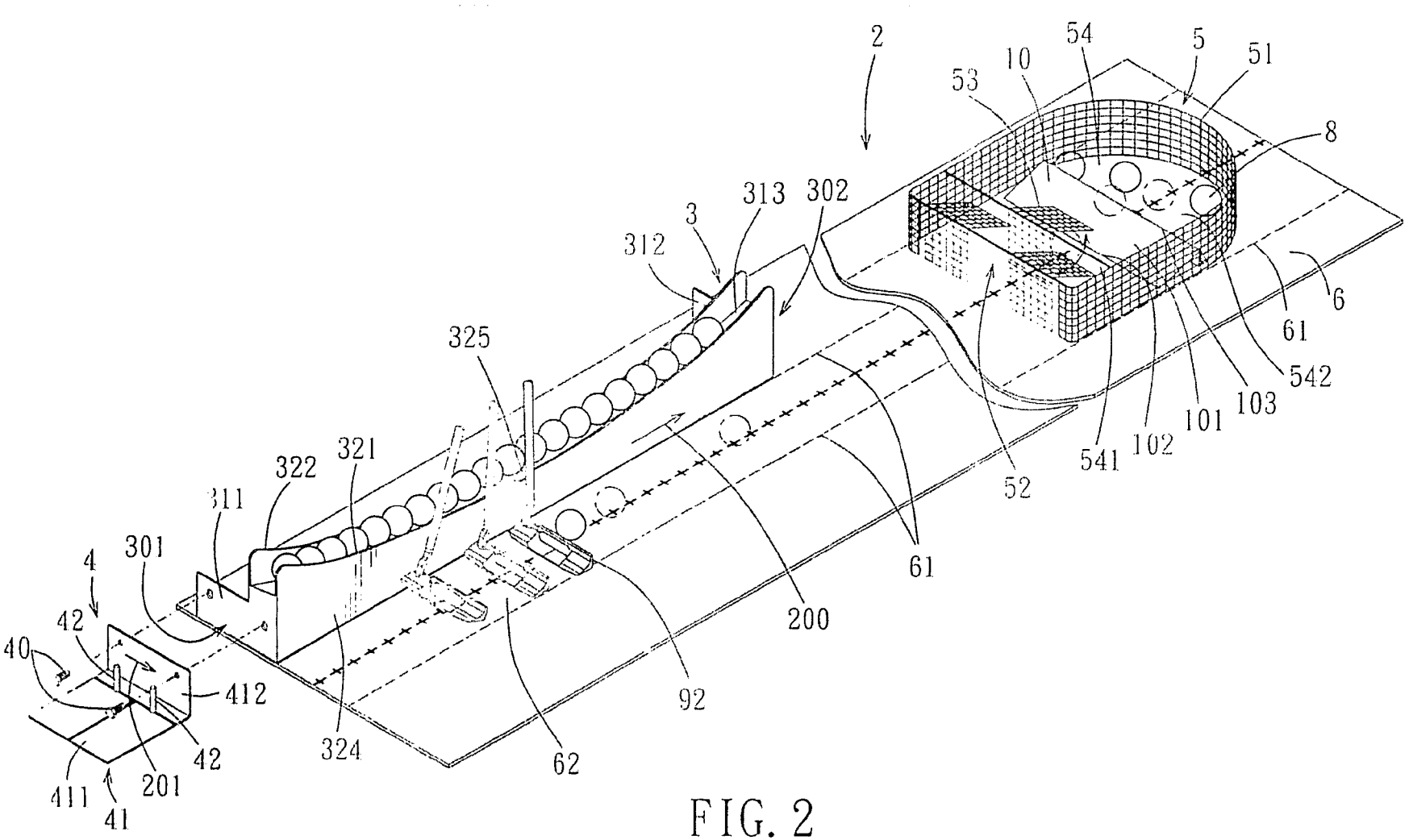
FIG. 2 is a partly exploded perspective view of the first preferred embodiment of a directional practice device according to this invention, illustrating how one golf ball is struck toward a target member by a putter head.
Figure 3:
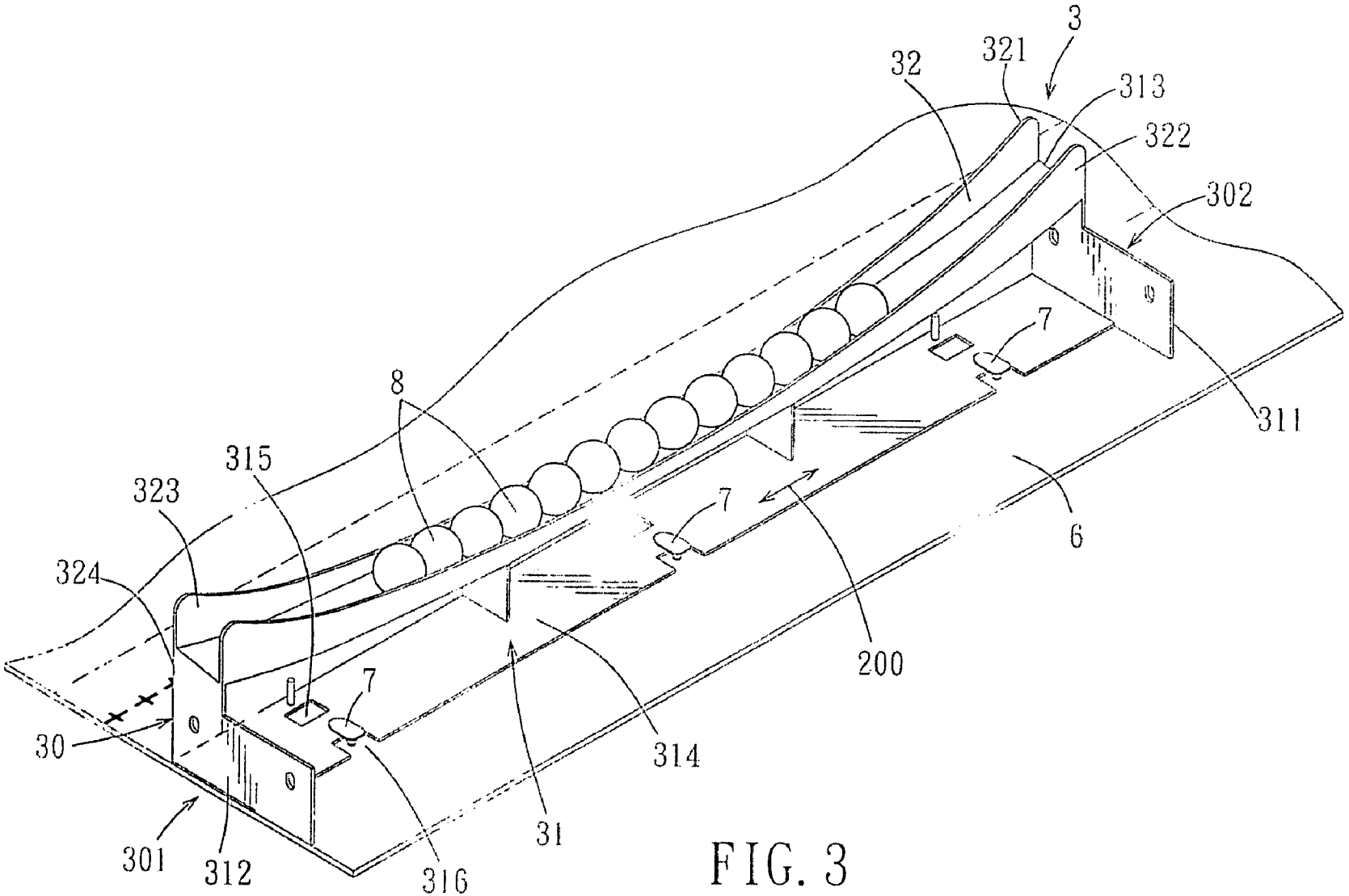
FIG. 3 is a fragmentary perspective view of the first preferred embodiment.
Figure 4:
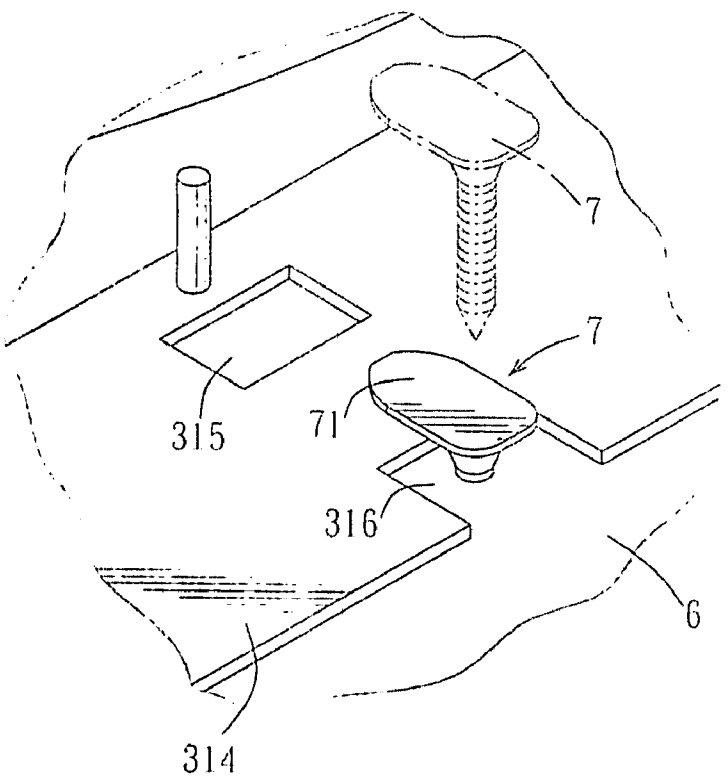
FIG. 4 is a fragmentary perspective view of the first preferred embodiment, illustrating a fastening member.

Referring to FIGS. 2 to 4, the first preferred embodiment of a directional practice device 2 according to this invention includes an elongated ball-receiving member 3, a head-calibrating unit 4, a target member 5, a pad 6, a plurality of fastening members 7, and an anti-return member 10. The pad 6 is disposed on a flat surface, such as a ground surface and a floor, and has a flat top surface. The ball-receiving member 3, the head-calibrating unit 4, the target member 5, and the anti-return member 10 are disposed on the flat top surface of the pad 6. The ball-receiving member 3 is attached fixedly to the pad 6 by the fastening members 7. The top surface of the pad 6 is indicated with a plurality of lines 61.

The ball-receiving member 3 extends along a longitudinal direction 200, and includes a bottom wall unit 31, and a pair of parallel first and second sidewalls 321, 322. The bottom wall unit 31 includes opposite first and second end plates 311, 312 each having a curved upper edge, a curved ball-supporting plate 313 disposed at an upper edge of the bottom wall unit 31 and interconnecting fixedly upper ends of the first and second end plates 311, 312, and a bottom plate 314 having a top surface connected fixedly to lower ends of the first and second end plates 311, 312. The bottom plate 314 is perpendicular to the first and second sidewalls 321, 322. The ball-supporting plate 313 interconnects fixedly the first and second sidewalls 321, 322 to define a slot 32 thereamong for receiving a plurality of golf balls 8 arranged in a row. Each of the curved upper edges of the bottom wall unit 31 as well as the first and second sidewalls 321, 322 has a middle edge portion, two opposite edge ends, and a height increasing gradually from the middle edge portion to the edge ends. The middle edge portion of the upper edge of the first sidewall 321 is formed with a curved notch 325.

Figure 6:
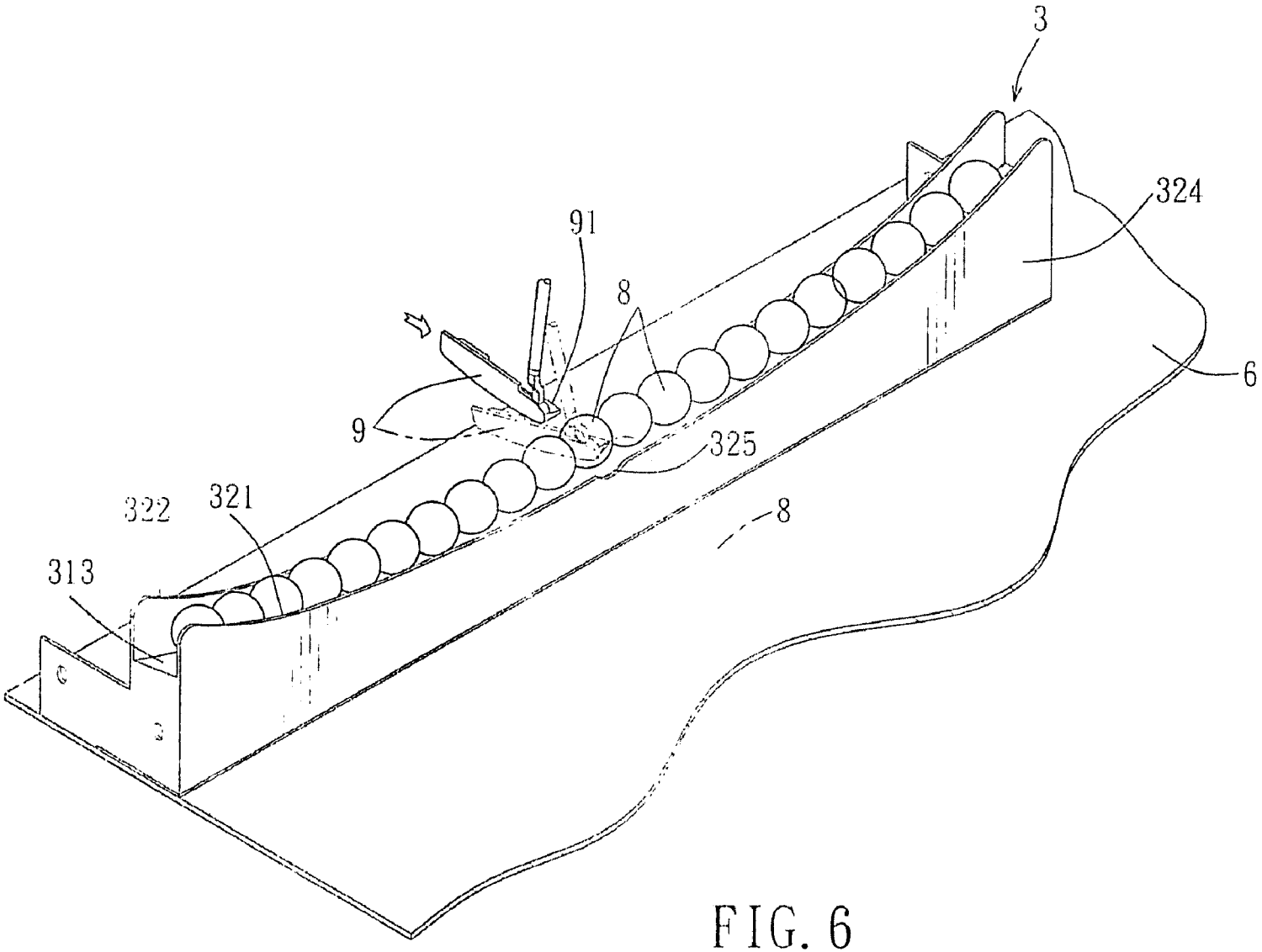
FIG. 6 is a fragmentary perspective view of the first preferred embodiment illustrating how one golf ball is pushed from a slot in a ball-receiving member onto a pad by the heel of the putter head.

The first sidewall 321 has an inner side surface 323 defining a side of the slot 32, and an outer side surface or heel-engaging surface 324 opposite to the inner side surface 323. The heel-engaging surface 324 has a lower end defining a side of a head-traveling path 62 that is located between two parallel lines 61. As such, the first sidewall 321 is disposed between the slot 32 and the head-traveling path 62. Thus, with further reference to FIG. 6, the golf balls 8 can be pushed by the heel 91 of a putter head 9 to drop from the slot 32 onto the head-traveling path 62 through the notch 325 one at a time. That is, it is not necessary for the golfer to bend down for ball picking.

After one of the golf balls 8 drops onto the head-traveling path 62, the putter head 9 can be moved along the head-traveling path 62 to strike the one of the golf balls 8 in the longitudinal direction 200 in such a manner that the heel 91 moves on the heel-engaging surface 324.

The ball-receiving member 3 is fixed to the pad 6 by the fastening members 7, as described above. The bottom plate 314 is formed with a plurality of holes 315 and a plurality of notches 316. Each of the fastening members 7 is configured as a nail extending through a respective one of the holes 315 and the notches 316, and has a head 71 for pressing the bottom plate 314 against the pad 6.

Figure 5:
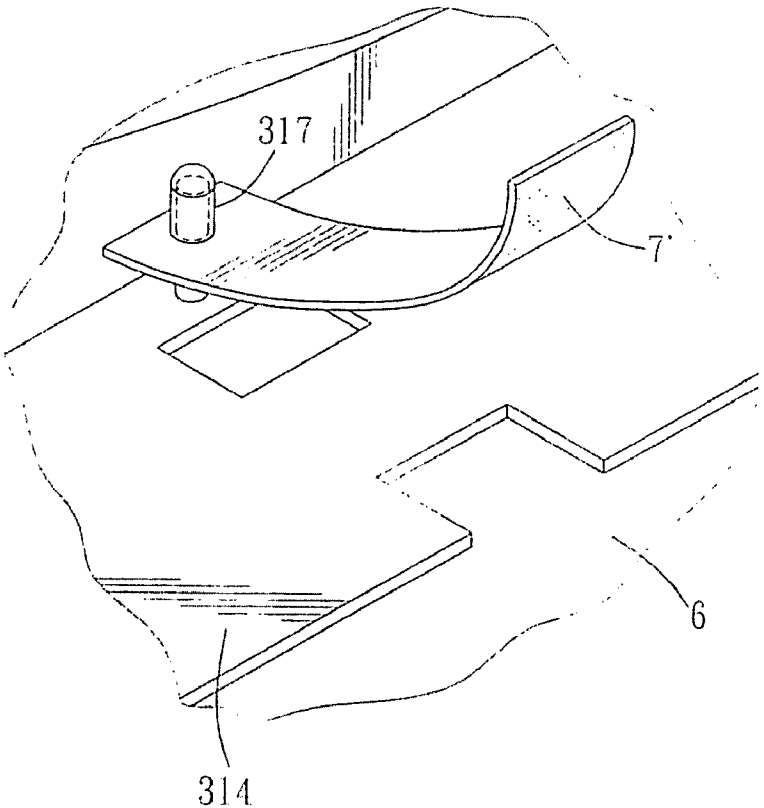
FIG. 5 is a perspective view illustrating a modified fastening member.

Alternatively, as shown in FIG. 5, each of the fastening members may be configured as a hook-and-loop fastener 7' having one end sleeved on a post 317 of the bottom plate 314 in a close fitting manner, and the other end extending into the corresponding notch 316 and in contact with the top surface of the pad 6.

Figure 7:
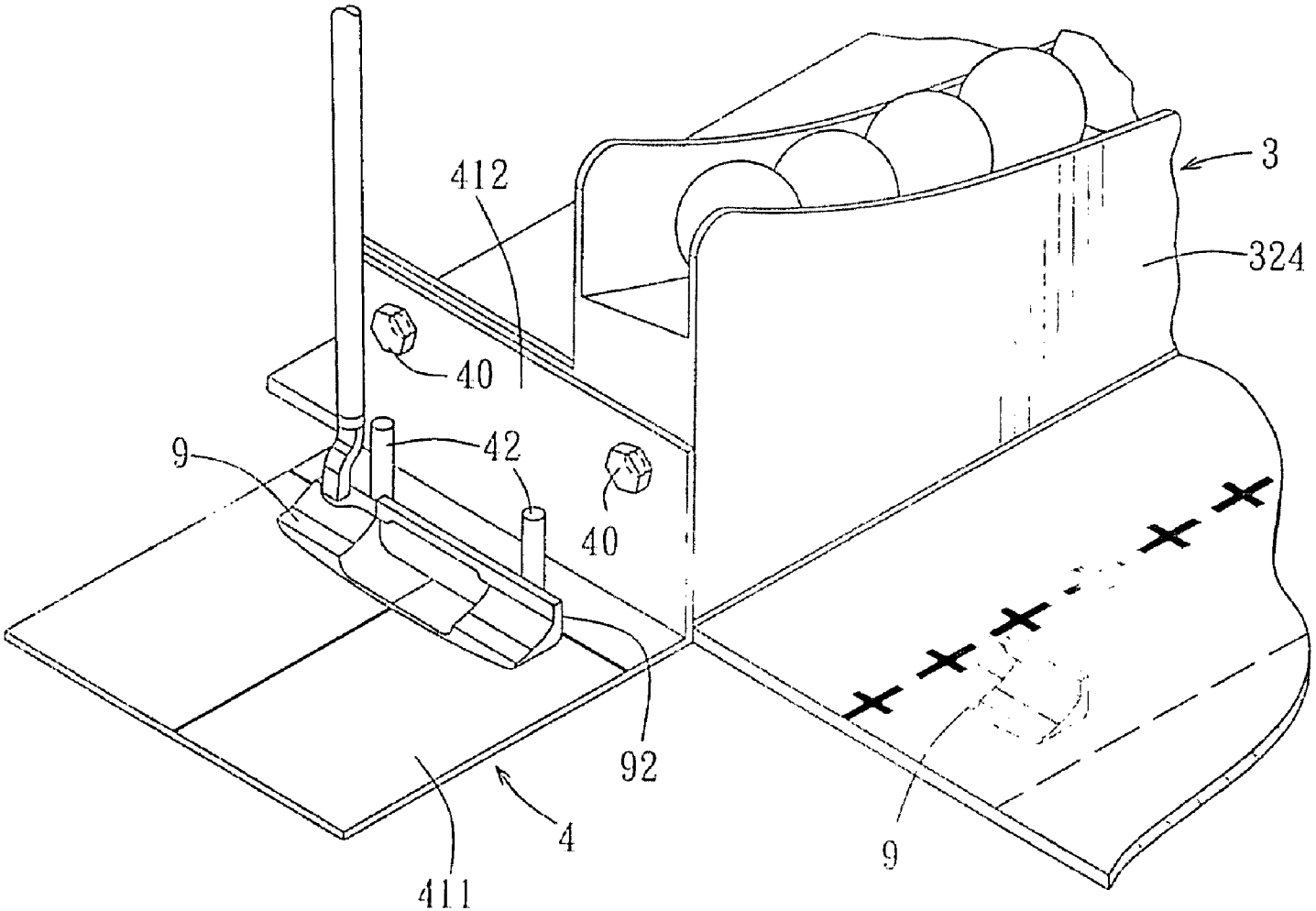
FIG. 7 is a fragmentary perspective view of the first preferred embodiment, illustrating the calibration of the putter head.

The ball-receiving member 3 has opposite first and second ends 301, 302. The head-calibrating unit 4 includes a base member 41 disposed on the top surface of the pad 6 and in proximity to the first end 301 of the ball-receiving member 3, and two parallel upright rods 42 disposed fixedly on the base member 41. The upright rods 42 are spaced apart from each other along a transverse direction 201 perpendicular to the longitudinal direction 200 and parallel to the top surface of the pad 6. The putter head 9 is movable to abut a putting face 92 thereof against the upright rods 42 just before a putting action is performed, as shown in FIG. 7. In this embodiment, the base member 41 is configured as an L-shaped plate, and includes a base plate portion 411 coplanar with the bottom plate 314, and an upright plate portion 412 extending integrally and perpendicularly from a side of the bottom plate portion 411 and connected removably to the first end plate 311 by two bolts 40.

Figure 8:
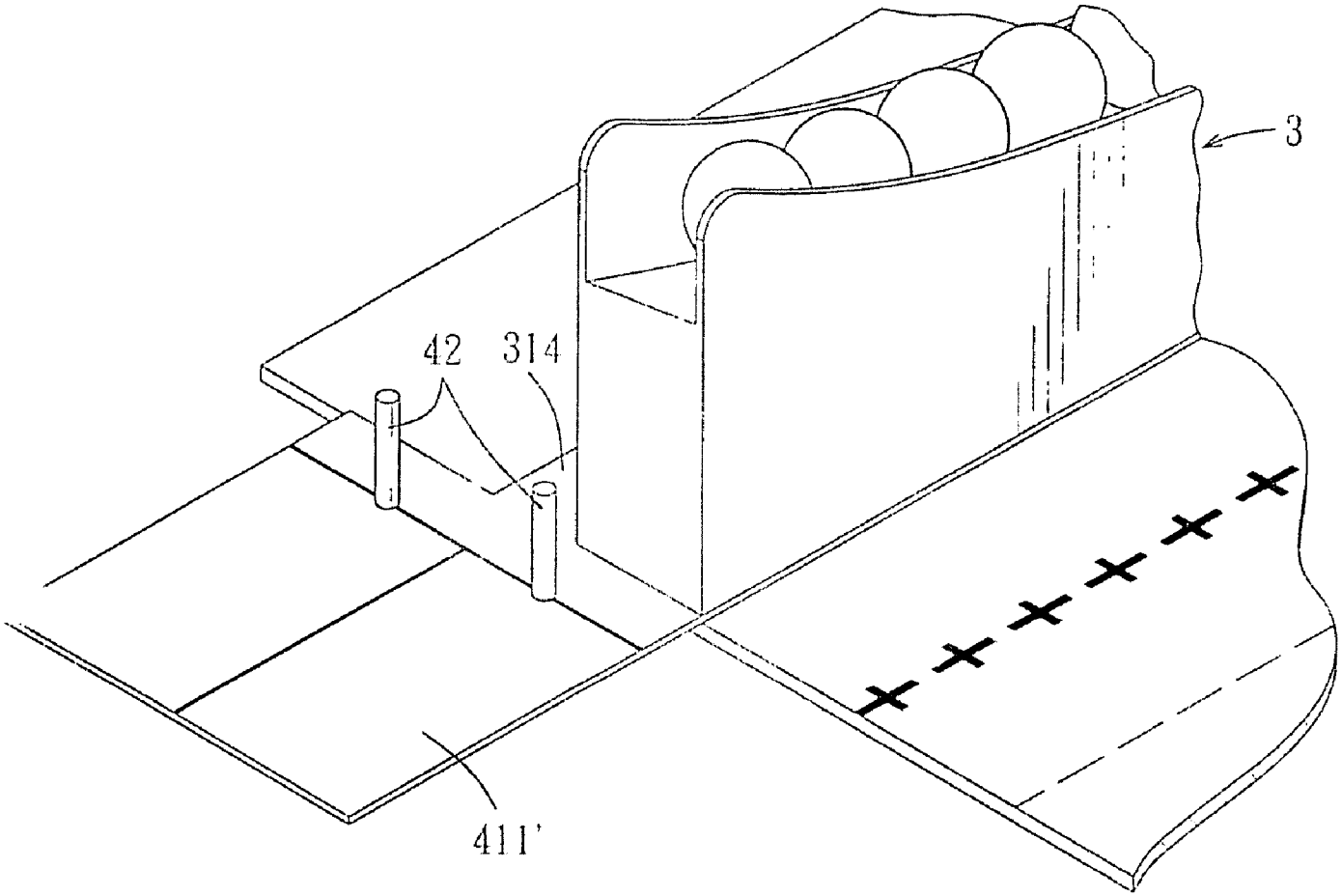
FIG. 8 is a perspective view illustrating a modified head-calibrating unit.

With particular reference to FIG. 8, a modified base member is configured as a base plate 411' disposed on the top surface of the pad 6 and coplanar with and extending integrally from an end of the bottom plate 314 along the longitudinal direction 200.

The target member 5 includes a surrounding wall 51 having a net structure and two ends defining an opening 52 therebetween, and a plurality of buffer doors 53 connected pivotally to the surrounding wall 51. The surrounding wall 51 further defines a ball-collecting space 54. The opening 52 is aligned with the head-traveling path 62 along the longitudinal direction 200. As such, the % one of the golf balls 8 on the head-traveling path 62 can be struck by the putter head 9 in the longitudinal direction 200 into the target member 5 through the opening 52.

The anti-return member 10 is disposed in the ball-collecting space 54 in the target member 5 to divide the ball-collecting space 54 into a passage space region 541 disposed between the opening 52 and the anti-return member 10, and a stay space region 542. The anti-return member 10 includes an inclined plate portion 101 having a lower side 102 proximate to the opening 52 and abutting against the top surface of the pad 6, and an upper side 103 distal from the opening 52 and disposed above the lower side 102. Due to the presence of the anti-return member 10, movement of the golf balls 8 from the stay space region 542 into the passage space region 541 is prevented. The inclination angle of the inclined plate portion 101 is small sufficient to allow the golf balls 8 to surpass during movement of the golf balls 8 from the passage space region 541 into the stay space region 542.

Since it is not necessary to lock the putter head 9 on any portion of the directional practice device 2, the directional practice device 2 is convenient during use.

Furthermore, the golfer can move the one of golf balls 8 from the slot 32 onto the head-traveling path 2 by use of the putter head 9 without bending-down, interruption of muscle memory and golfer discomfort resulting from the bending-down can be prevented.

Figure 9:
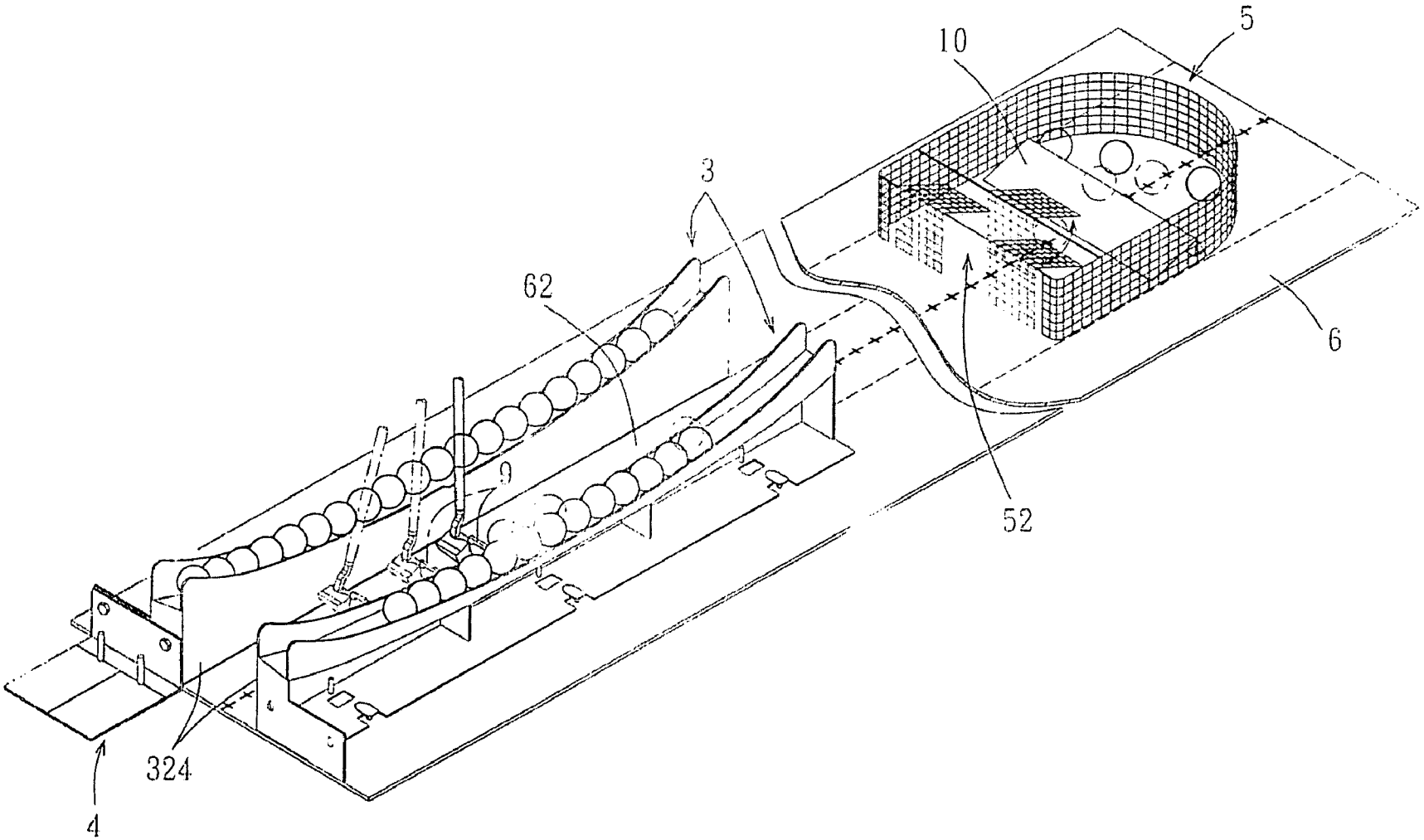
FIG. 9 is a perspective view of the second preferred embodiment of a directional practice device according to this invention.

FIG. 9 shows the second preferred embodiment of a directional practice device 2' according to this invention, which is similar in construction to the first preferred embodiment except for addition of another ball-receiving member 3. The ball-receiving members 3 are symmetrical with respect to the head-traveling path 62.

With this invention thus explained, it is apparent that numerous modifications and variations can be made without departing from the scope and spirit of this invention. It is therefore intended that this invention be limited only as indicated by the appended claims.

We claim:

1. A directional practice device adapted to be disposed on a flat surface and adapted for use with a plurality of golf balls and a putter head, the putter head having a heel, said directional practice device comprising:

an elongated ball-receiving member adapted to be disposed on the flat surface and having a slot adapted for receiving the golf balls; and an upright heel-engaging surface disposed at a side of said ball-receiving member and adapted to be perpendicular to the flat surface, said heel-engaging surface having a lower end defining a side of a head-traveling path extending along a longitudinal direction, said slot being positioned such that the golf balls can be pushed by the putter head to drop from said slot onto said head-traveling path one at a time, wherein, after one of the golf balls drops onto the head-traveling path, the putter head can be moved along said head-traveling path to strike the one of the golf balls in the longitudinal direction in such a manner that the heel moves on said heel-engaging surface;

wherein said ball-receiving member includes a pair of first and second sidewalls parallel to each other, and a bottom wall unit interconnecting said first and second sidewalls to define said slot thereamong, said first sidewall being disposed between said slot and said head-traveling path and having an inner side surface defining a side of said slot, and an outer side surface opposite to said inner side surface and constituting said heel-engaging surface; and wherein each of said bottom wall unit as well as said first and second sidewalls is formed with a curved upper edge that has a middle edge portion, two opposite edge ends, and a height increasing gradually from said middle edge portion to said edge ends, said middle edge portion of said upper edge of said first sidewall being formed with a curved notch permitting the one of the golf balls to drop from said slot onto said head-traveling path therethrough.

2. The directional practice device as claimed in claim 1, wherein said ball-receiving member has two opposite ends, said direction practice device further comprising a head-calibrating unit including a base member adapted to be disposed on the flat surface and in proximity to one of said ends of said ball-receiving member, and two parallel upright rods disposed fixedly on said base member, spaced apart from each other along a transverse direction perpendicular to the longitudinal direction and parallel to the flat surface, and adapted for permitting the putter head to abut against said upright rods.

3. The directional practice device as claimed in claim 2, wherein said base member of said head-calibrating unit includes a base plate, said upright rods being fixed to and extending perpendicularly from said base plate.

4. The directional practice device as claimed in claim 3, wherein said bottom wall unit includes a bottom plate adapted to be disposed on the flat surface, said base plate of said head-calibrating unit being coplanar with and extending integrally from an end of said bottom plate along the longitudinal direction.

5. The directional practice device as claimed in claim 2, wherein said base member of said head-calibrating unit is connected removably to said ball-receiving member.

6. The directional practice device as claimed in claim 1, further comprising a target member adapted to be disposed on the flat surface and including a surrounding wall defining a ball-collecting space and having two ends defining an opening therebetween, said opening being aligned with said head-traveling path along the longitudinal direction so that the one of the golf balls can be struck by the putter head in the longitudinal direction from said head-traveling path into said target member through said opening.

7. The directional practice device as claimed in claim 6, further comprising an anti-return member disposed in said ball-collecting space in said target member to divide said ball-collecting space into a passage space region disposed between said opening and said anti-return member, and a stay space region, said anti-return member including an inclined plate portion having a lower side proximate to said opening and adapted to abut against the flat surface, and an upper side distal from said opening and disposed above said lower side;

Whereby, the one of the golf ball can be struck by the putter head toward the target member to surpass said anti-return member to thereby move into said stay space region.

8. The directional practice device as claimed in claim 1, wherein said bottom wall unit includes a bottom plate adapted to be disposed on the flat surface, said first and second sidewalls being connected fixedly to and perpendicular to said bottom plate.

9. The directional practice device as claimed in claim 8, further comprising a plurality of fastening members adapted for fastening said bottom plate to the flat surface.

* * * * *